US006551485B1

(12) United States Patent
Taylor

(10) Patent No.: US 6,551,485 B1
(45) Date of Patent: Apr. 22, 2003

(54) ELECTRODEPOSITION OF METALS FOR FORMING THREE-DIMENSIONAL MICROSTRUCTURES

(75) Inventor: E. Jennings Taylor, Troy, OH (US)

(73) Assignee: Faraday Technology Marketing Group, LLC, Troy, OH (US)

( * ) Notice: Subject to any disclaimer, the term of this patent is extended or adjusted under 35 U.S.C. 154(b) by 0 days.

(21) Appl. No.: 09/688,377

(22) Filed: Oct. 17, 2000

(51) Int. Cl.[7] ..... C25D 5/18

(52) U.S. Cl. ..... 205/108; 205/103; 205/104; 205/105

(58) Field of Search ..... 205/103, 104, 205/105, 108

(56) References Cited

U.S. PATENT DOCUMENTS 5,185,073 A * 2/1993 Bindra et al. ..... 205/104
5,750,017 A * 5/1998 Zhang ..... 205/104
5,972,192 A * 10/1999 Dubin et al. ..... 205/104
6,319,385 B1 * 11/2001 Mull ..... 205/104

* cited by examiner

*Primary Examiner*—Arun S. Phasge
(74) *Attorney, Agent, or Firm*—Thompson Hine LLP

(57) ABSTRACT

Microscopic mechanical elements suitable for manufacture of microelectromechanical systems (MEMS) are directly prepared by forming a low-relief base of microscopic dimensions on a substrate surface by any conventional means, and electrodepositing a metal preferentially on the upper surface of the base to produce a vertically-extending 3-dimensional structure. In a first step, the patterned substrate and a counterelectrode are contacted with an electrolyte and an electric current is passed between the substrate and counterelectrode, with the substrate being predominantly cathodic with respect the counterelectrode. In a first step the electrolytic environment at the substrate surface is maintained as a microprofile, whereby metal is deposited preferentially at the upper edge or tip of the base until the structure has been increased in height, and, in a second step, the electrolytic environment at the substrate surface is maintained as a macroprofile to continue the deposition of metal at the upper edge or tip of the structure until the desired relief is obtained.

17 Claims, 3 Drawing Sheets

ELECTRODEPOSITION OF METALS FOR FORMING THREE-DIMENSIONAL MICROSTRUCTURES

BACKGROUND OF THE INVENTION

1. Field of the Invention

This invention relates to forming microstructures and more particularly to forming microstructures by electrodeposition.

2. Brief Description of the Prior Art

Rapid growth in the area of microelectromechanical systems (MEMS) has created a demand for 3-dimensional micron-scale components. Microelectromechanical devices comprise structures of generally conventional shape and function, e.g., beams, posts levers, wheels, and the like, but of a size that is microscopic. Typically, the overall sizes of such devices are no more than a few millimeters in any dimension. The practical lower limit on the size of such devices is uncertain, but entire devices only a few micrometers across are envisaged. As the general name implies, MEMS often incorporate electrical elements as sensors and/or actuators.

Evidently, MEMS are not readily capable of being manufactured by conventional machining techniques, which are too coarse for the fabrication and assembly of the miniature and delicate elements that constitute such devices. Typically, the techniques that have proved successful in fabricating microscopic electrical devices such as transistors, integrated circuits, microprocessors, and the like, have been adapted to the construction of MEMS. Accordingly, microlithographic methods have been used to form shaped structures on substrates. The adaptation of semiconductor manufacturing techniques has also been favored because silicon has been found to be a useful material for making MEMS. However, structures of metal have also assumed importance for construction of MEMS. By such procedures, successive stages of applying a resist layer, patterning the layer by imaging and developing, and forming a structure corresponding to the pattern have been used. The structures may be formed either by etching a substrate according to the patterned resist layer or by depositing a metal in the developed pattern of the resist to form a pattern in relief on the substrate surface. Conventional deposition techniques, such as chemical vapor deposition, electrodeposition, and the like can be used. Successive stages of patterned deposition and etching can result in a 3-dimensional mechanical structure.

However, current techniques involve multiple steps, using many expensive and sometimes hazardous materials, and tend to generate large volumes of waste materials relative to the numbers of devices produced. As a result of these disadvantages, manufacture of MEMS is currently time-consuming and expensive.

A particular problem encountered in MEMS manufacture, which is not so often experienced in fabrication of semiconductor devices is the need to provide free-standing posts or similar structures extending above a supporting substrate surface. Such structures may require vertical dimensions and aspect ratios greater than those commonly demanded in the fabrication of electrical semiconductor devices.

Accordingly, a need has continued to exist for improved methods of constructing microelectromechanical devices, and, in particular for fabricating free-standing structures of relatively great vertical dimension.

SUMMARY OF THE INVENTION

The problem of manufacturing microscopic mechanical elements extending vertically from a supporting substrate surface has now been alleviated by the method of this invention. According to the invention structures of metal or other material that can be electrolytically deposited are formed directly by a method wherein a low-relief base is formed on a substrate surface by any conventional means, and electrolytically depositable material, e.g., metal, is preferentially deposited on the upper surface of the base to produce a vertically-extending structure. The metal, or the like, is preferentially deposited on the upper surface or tip of the base by contacting the base and a counterelectrode with an electroplating bath and passing an electric current is passed between the substrate and counterelectrode, wherein the substrate is predominantly cathodic with respect the counterelectrode. In a first step the electrolytic environment at the substrate surface is maintained as a microprofile, whereby metal is deposited preferentially at the upper edge or tip of the base until the structure has been increased in height, and, in a second step, the electrolytic environment at the substrate surface is maintained as a macroprofile to continue the deposition of metal at the upper edge or tip of the structure until the desired relief is obtained.

Accordingly, it is an object of the invention to provide a method for manufacturing MEMS.

A further object is to provide a method for electrochemically producing free-standing microscopic structures on a substrate surface.

A further object is to provide a method for converting a microscopic low-relief pattern on a substrate surface into a pattern of higher relief.

A further object is to provide an electrochemical method for increasing the height of a free-standing structure on a substrate surface.

A further object is to provide a method for electrochemically producing posts and the like suitable for use in constructing MEMS.

Further objects of the invention will be apparent from the description of the invention that follows.

DETAILED DESCRIPTION OF THE INVENTION AND PREFERRED EMBODIMENTS

Figure 1:
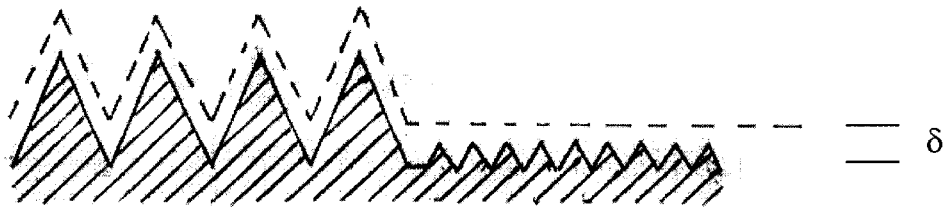
FIG. 1 is a schematic illustration of a surface of a substrate having relatively large asperities and relatively small asperities in relation to the thickness of the Nernst diffusion layer.

Manufacture of microelectromechanical systems (MEMS) requires the formation, manipulation and assembly of structural elements having sizes of the order of a few millimeters to less than one micrometer. Because such devices have so little mass and often need external power and control, they are typically manufactured or built up while they are secured to a base. Often they are also securely fixed to a supporting substrate in their intended use as well.

The microscopic size of the devices and the elements of which they are made generally precludes conventional means of manufacture. Although micromanipulators exist that can precisely position very small objects, means of joining such objects into an operating machine are as yet poorly developed. Furthermore, individual assembly of such minute devices is unavoidably inefficient. Accordingly, manufacturing means have been adapted from the processes used to fabricate semiconductor devices, as discussed above.

According to the invention free-standing 3-dimensional structures having sufficient height, i.e., relief from the supporting substrate surface, can be fashioned by controlled electrodeposition of metal onto a low-relief pattern on the substrate surface prepared by conventional means.

The low-relief pattern may be a very small, microscopic protrusion above the surface that constitutes a "microprofile" for electrodeposition processes at the surface of the substrate.

Electrodeposition of metal on the surface will produce a depletion of metal ions at the surface. The ions have to be replaced by ions coming from the bulk of the electroplating bath. However, the viscosity of the bath assures that a thin layer immediately adjacent to the substrate surface does not partake in the general agitation of the bath. Consequently, the dissolved ions must travel through this layer by diffusion before they reach the surface and are deposited. This layer through which the ions must pass from the surface of the substrate to the bulk bath is the Nernst diffusion layer. The thickness of the Nernst diffusion layer is a function of the kinematic viscosity and agitation of the bath as well as of the limiting electrolytic current. A similar problem of transfer of metal ions through the Nernst diffusion layer occurs in electrodissolution of metals from a substrate.

The thickness of the Nernst diffusion layer in a conventional electrochemical bath using.direct current electrolysis with moderate stirring is in the range of about 50 micrometers to about 100 micrometers ($\mu$m). However, in the cases of electrodeposition with small interelectrode gaps and/or higher linear flow velocities of the electrolyte much thinner Nernst diffusion layers are to be expected.

It is conventional to describe a surface wherein the height of the asperities is of the order of the thickness of the Nernst diffusion layer as a macrorough surface. Accordingly, such asperities may be defined as macroasperities. Similarly, a surface wherein the height of the asperities is significantly less than the thickness of the Nernst diffusion layer is described as a microrough surface, and such asperities may be defined as microasperities.

Accordingly, the thickness of the Nernst diffusion layer will typically be of the order of or significantly greater than the height of the microscopic asperities on a smoothed and highly polished surface prepared by mechanical finishing such as grinding an polishing with fine abrasives or by electropolishing. However, a surface may also have larger asperities that equal or exceed the thickness of the Nernst diffusion layer, especially if these asperities or projections are formed deliberately. The relationship of the thickness of the Nernst diffusion layer, $\delta$, to the height of the surface asperities is illustrated schematically in FIG. 1.

However, if the electric current is applied in pulses (PC) instead of direct current (DC) the diffusion layer through which the ions must travel under the pulsed current conditions may be considered to be effectively shorter. The effect of pulsed current, also described as modulated current or modulated charge transfer, is described in detail in U.S. Pat. No. 5,599,437, to E. J. Taylor et al, the entire disclosure of which is incorporated herein by reference. The detailed disclosure in U.S. Pat. No. 5,599,437 is given in terms of an electroplating process, wherein metal is deposited from the electrolyte solution onto the surface of a substrate. However, the same principles apply to an electrodissolution process, wherein an electrolytically dissolvable material, e.g., a metal, is removed from the surface of a substrate. In general, if the charge is transferred in short pulses, i.e., if the current is applied in short pulses, the Nernst diffusion layer will be thinner than it is under DC electrolysis conditions, because the full thickness of the layer does not have time to develop before the pulse terminates. Consequently, the use of short pulses of current can so thin the effective Nernst diffusion layer that a microprofile condition can become converted into a macroprofile condition. Alternatively, a macroprofile condition can be converted into a smaller macroprofile condition, thereby removing the degree of concentration polarization or secondary current distribution. As a general rule the shorter the pulse used, the more the current distribution is determined by the electrode geometry (primary current distribution controlled by ohmic effects) and variation in overpotential due to electrode profile (secondary current distribution controlled by kinetic effects). In fact, depending on the size of the asperity, the role of electrochemical cell geometry may by minimal. In either case, when polarization is removed, i.e. from concentration to secondary and or primary, the current distribution becomes more non-uniform. Accordingly, metal will be deposited preferentially at the peaks of the macroasperities, e.g., free-standing projections from the substrate surface, whereby these projections are increased in height. For portions of the surface having only microasperities, the distribution of the electrolytic activity is influenced by the rate of mass transfer through the diffusion layer, which causes the effect of the electric current to be more uniform (tertiary current distribution).

According to the method of the invention an electrolyte is interposed between and in contact with an electrically conductive substrate surface to be having patterned microasperities thereon and a counterelectrode. Such an arrangement is illustrated in FIG. 4A, wherein a substrate 402, having microasperities 404, and a counterelectrode 408 are contacted by an electrolyte 410. An electric current is then passed between the counterelectrode and the substrate by a conventional power supply not shown, with the substrate being maintained cathodic with respect to the counterelectrode.

According to the invention, in a first step, microasperities, such as bases for 3-dimensional structures of MEMS, having a height less than the thickness of the Nernst diffusion layer under conventional conditions of electrolytic bath agitation, e.g., a height of a few microns above the smooth surface of the substrate, are increased in height by establishing microprofile conditions at the substrate surface and conducting an electrodeposition step until the asperities have been increased to a height of the order of or greater than the thickness of the Nernst diffusion layer under those conditions. Accordingly, in the first step of the process, the microasperities are converted into macroasperities.

Under microprofile conditions (a microprofile regime) with current sufficiently large enough, the electrolytic action is determined by mass transport by diffusion, i.e., so-called tertiary control. This inverse relationship between the current and the transition time which defines when tertiary control plays an important role is well known to those skilled in the art, and is discussed, for example by Sand, among others. Under these conditions metal is preferentially deposited onto the tips of the microasperities.

Figure 2:
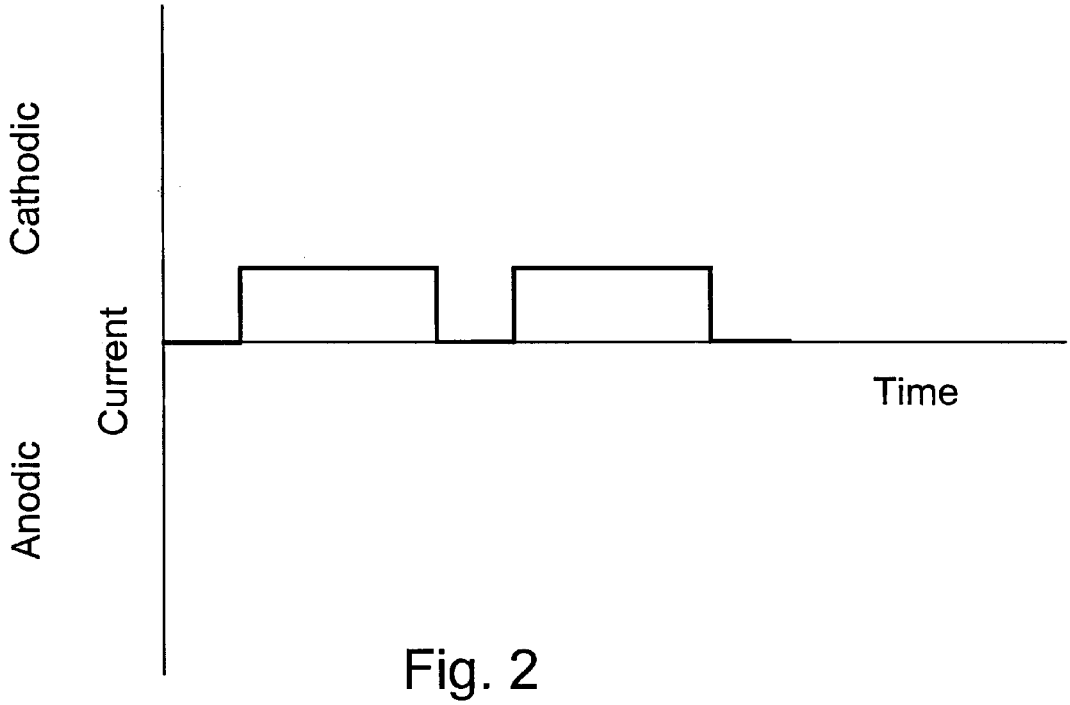
FIG. 2 illustrates the waveform of a preferred charge modulated electric current used for building up the microasperities on a surface to macroasperities.
Figure 3:
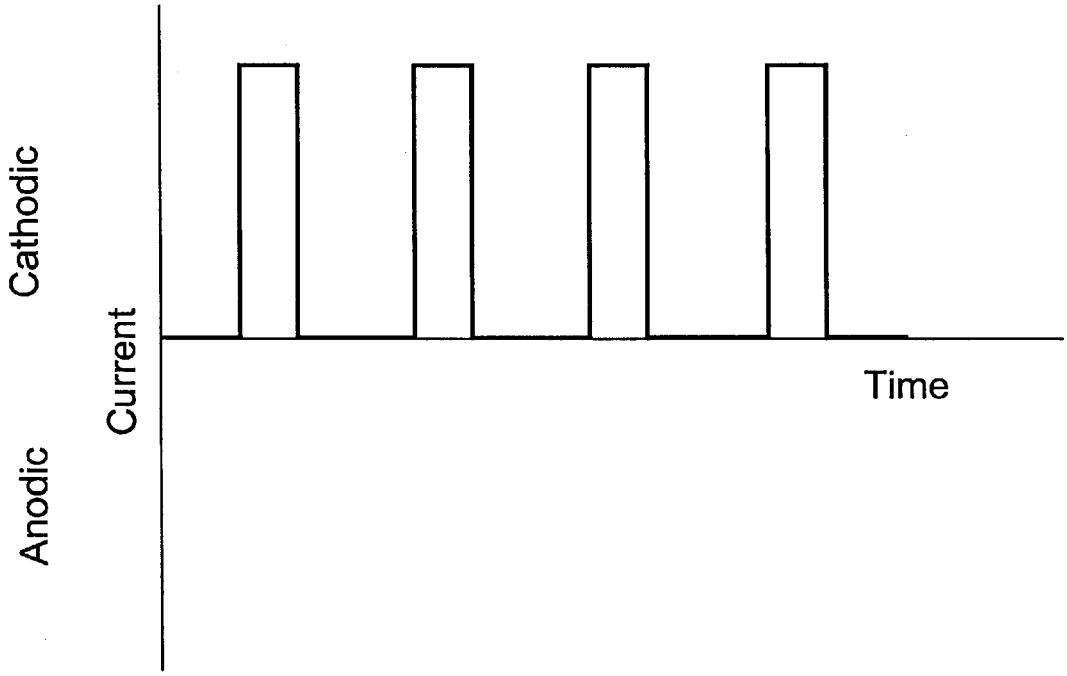
FIG. 3 illustrates the waveform of a preferred charge modulated electric current used for building up macroasperities to greater height.

In order to establish the microprofile regime for the first step of the process of the invention, the degree of agitation of the bath can be limited, or the length of the pulses in the pulsed current can be lengthened and the off-time between the pulses reduced in order to produce a relatively thick Nernst diffusion layer. In fact, if there is no practical need for a reversing pulse, the process may be solely DC. The cathodic or forward pulses in the first step of the process in general will have a pulse duration or pulse width of at least 100 milliseconds, preferably at least 500 milliseconds. The off-times and or reverse times will also in general be shorter than the pulse duration. The duty cycle is preferably greater than about 50%. More preferably it is greater than about 75% or even 90%. An exemplary waveform used in the first step of the process of the invention is illustrated in FIG. 2.

Figure 4C:
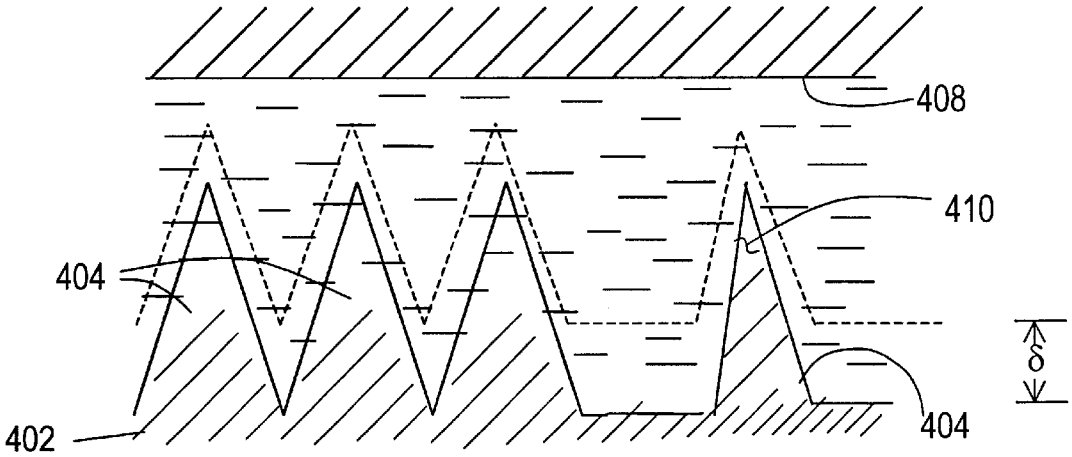
FIG. 4C illustrates the arrangement of FIGS. 4A and 4B after the second step of the process has been completed and the macroasperities have been further increased in size.
Figure 4B:
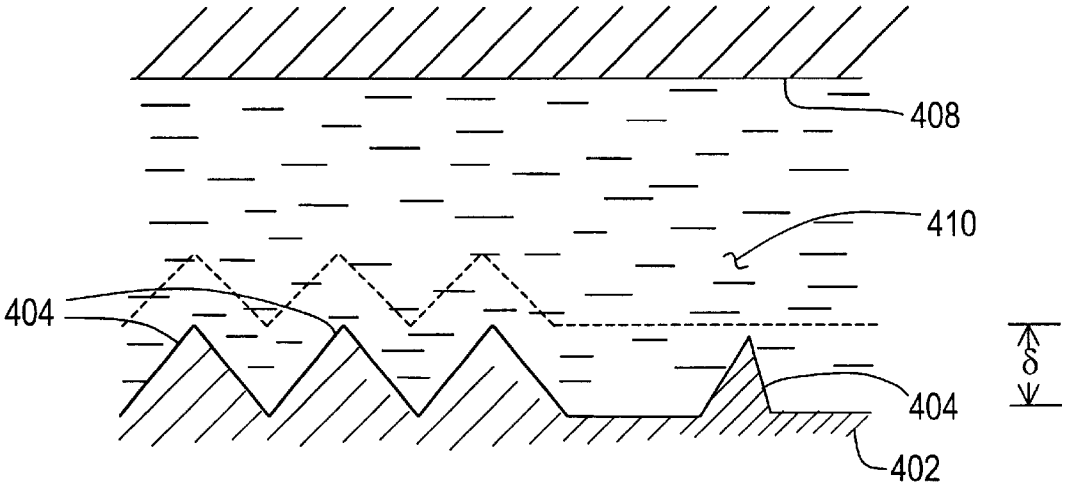
FIG. 4B illustrates the arrangement of FIG. 4A after the first step of the process has been completed and the microasperities have been increased in size to macroasperities.
Figure 4A:
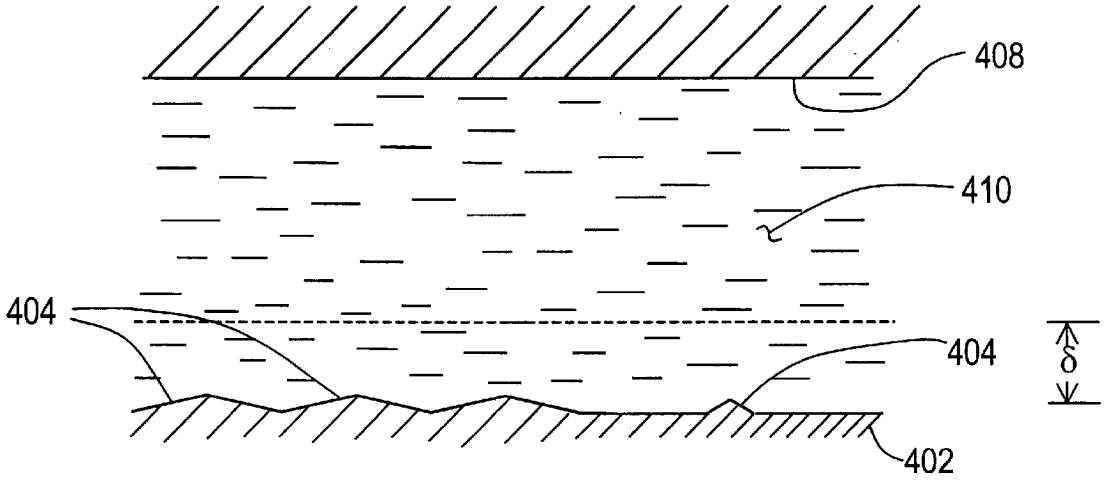
FIG. 4A illustrates an arrangement for manufacture of MEMS wherein a surface having a pattern of microasperities is arranged for building up to form macroasperities.

The substrate profile at the end of the first step of the process is illustrated in FIG. 4B, wherein the microasperities 404 have been substantially increased to a height comparable with that of the Nernst diffusion layer.

Once the patterned microasperities have been increased in height to the point that they approach or exceed the thickness of the Nernst diffusion layer as established in the first step, the electrodeposition is continued in a second step wherein the conditions are adjusted to produce a macroprofile regime a the substrate surface. That is, the thickness of the Nernst diffusion layer is adjusted to be less than the height of the newly formed macroasperities. Under such a macroprofile regime metal is preferentially deposited on the tips of the newly-formed macroasperities to further increase their free-standing height.

A macroprofile regime may be established by increasing the agitation of the plating bath to provide for rapid flow of electrolyte across the substrate surface. For example, the solution may be forced rapidly through a thin gap between the substrate workpiece and the counterelectrode. Under these conditions of high linear velocity flow the Nernst diffusion layer may be considerably smaller and considerably smaller asperities may still represent macroasperities relative to the Nernst diffusion layer. This is accomplished by reducing the thickness of the Nernst diffusion layer to its thinnest practical value.

However, as explained in U.S. Pat. No. 5,599,437, the thickness of the Nernst diffusion layer can be decreased by applying the electric current in a stream of pulses as taught by N. Ibl et al. in *Surface Technology*, Vol. 6, p. 287 (1978); and *Surface Technology*, Vol. 10, p. 81 (1980); and K. Yin, *Surface and Coatings Technology*, Vol. 88, p. 162 (1996), the entire disclosures of which are incorporated herein by reference. As shown therein, the thickness of the Nernst diffusion layer is less for shorter pulses. Consequently, a macroprofile condition, i.e., Nernst diffusion layer thinner than the heights of the relatively large asperities, can be established by using pulsed current (i.e., pulsed charge transfer), with or without concomitant enhanced agitation of the electrolytic bath. The thickness of the Nernst diffusion layer $\delta$ with respect to the height of the macroasperities 404 is illustrated in FIG. 4A.

As indicated above, it is usually more convenient to establish macroprofile conditions (a macroprofile regime) at the substrate surface by employing pulsed current using relatively short pulses. Typically the pulse width may range from about 0.1 microsecond to about 100 milliseconds, although shorter or longer pulses are not excluded, provided that macroprofile conditions are maintained the substrate surface. It is preferred that the pulses be no longer than about 10 milliseconds, more preferably no longer than about 1 millisecond, and most preferably no longer than about 100 microseconds. The off-times and or reverse times between the pulses may range from about 10 microseconds to about 500 milliseconds. The duty cycle of the pulse train may range from about 0.001 to about 0.5. Typically the shorter pulses area associated with a shorter duty cycle and a thinner Nernst diffusion layer. However, the skilled practitioner will recognize that low duty cycles mean a low average current, i.e., low rate of transfer of charge, with consequent slow deposit of metal and slower electrodeposition action. Accordingly, the practitioner will adapt the above teaching to the needs of a particular application, considering the rate of deposition and the efficiency of the process. Furthermore, while it cannot be absolutely determined when the surface transition from microasperity to macroasperity takes place, such a situation will be evident from experiment which will show that the buildup process proceeds more slowly. Consequently, it is not excluded that some experimentation may be necessary in a given case to achieve the right combination of pulse rate, pulse width, duty cycle and agitation for optimum results in a commercial setting.

Figure 5:
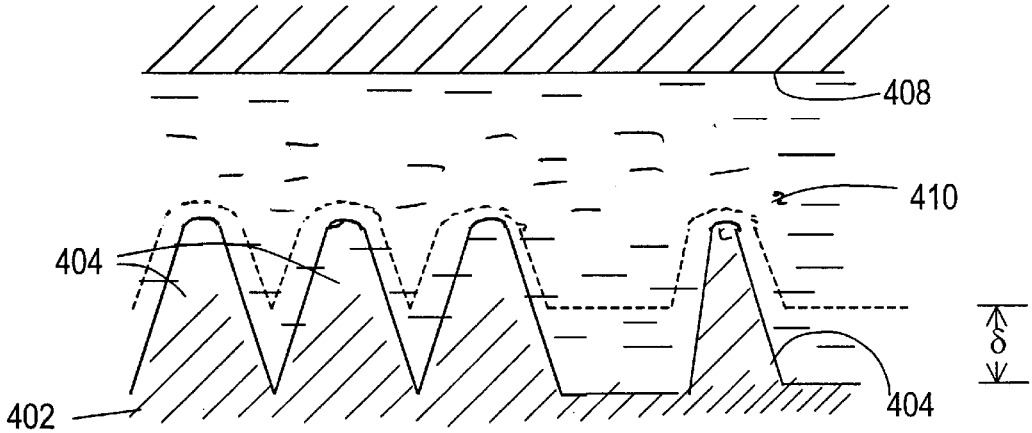

A further step in the process can be employed to provide posts and the like having upper ends suitable for bonding to other elements of a MEMS device. After the posts have reached their desired height, or a little greater, the tips of the posts may be flattened somewhat by providing an anodic electrolytic etch. This is accomplished by making the substrate and the posts thereon anodic with respect to the counterelectrode. This can be done by introducing a direct current (DC) anodic etch, or by employing reverse pulses between the forward pulses used to build up the 3-dimensional structures. Such electrolytic etching is well known to those skilled in the art, and can be used to form posts, and the like, having somewhat flattened tops as schematically illustrated in FIG. 5.

Furthermore, it is also possible to form 3-dimensional structures for MEMS by the electrodeposition method of the invention using only the second step of the process. If a substrate surface having bases for MEMS structural elements that are tall enough to form a macroprofile condition it is possible to employ the conditions of the second step of the process to increase their height to form a useful supporting structure for MEMS. Such macroprofile bases may be available from other manufacturing operations, or they may be formed directly by etching, micromachining, pressure forming or, other conventional mechanical shaping methods.

The patterned microprofile substrate can also be prepared by conventional techniques, or it can be prepared by etching, printing, e.g., screen printing, or other techniques known to produce surfaces having microscopic asperities that can form a microprofile under appropriate electroplating conditions as described herein.

The invention having now been fully described, it should be understood that it may be embodied in other specific forms or variations without departing from its spirit or essential characteristics. Accordingly, the embodiments described above are to be considered in all respects as illustrative and not restrictive, the scope of the invention being indicated by the appended claims rather than the foregoing description, and all changes which come within the meaning and range of equivalency of the claims are intended to be embraced therein.

We claim:

1. A method for forming a 3-dimensional microstructure on a surface comprising providing an electrically conducting substrate having a surface carrying a base for said structure, said base projecting above said surface to form a microasperity;

providing a counterelectrode;

interposing an electrolyte between and in contact with said substrate and said counterelectrode; and passing an electric current between said substrate and said counterelectrode and maintaining said substrate predominantly cathodic with respect to said counterelectrode;

wherein in a first step, a diffusion layer is maintained at a thickness to produce a microprofile regime until said microasperity has been built up to a height to constitute a macroasperity; and in a second step, said diffusion layer is maintained at a thickness to produce a macroprofile regime to further increase the height of said macroasperity.

2. The method of claim 1 wherein said electric current in said first step is a first pulsed current comprising a first train of first forward pulses, said first forward pulses having a first pulse width not less than about 10 milliseconds.

3. The method of claim 2 wherein said first pulses have a pulse width not less than about 500 milliseconds.

4. The method of claim 2 wherein said second pulses have pulse width not less than about 500 milliseconds.

5. The method of claim 2 wherein said first pulse train has a first duty cycle not less than about 50%.

6. The method of claim 2 wherein said first pulse train has a first duty cycle not greater than about 75%.

7. The method of claim 2 wherein said first pulse train has a first duty cycle not less than about 90%.

8. The method of claim 2 wherein said second pulse train has a duty cycle not greater than about 25%.

9. The method of claim 2 wherein said second pulse train has a duty cycle not greater than about 10%.

10. The method of claim 2 wherein reverse pulses may replace at least some or all of said off-time between said forward pulses.

11. The method of claim 10 wherein reverse pulses immediately precede said forward pulses without intervening off-time.

12. The method of claim 1 wherein said electric current is direct current.

13. The method of claim 1 wherein, in said second step, said electric current is a second pulsed current comprising a second train of second forward pulses, said second forward pulses having a pulse width less than said first forward pulses.

14. The method of claim 13 wherein said second pulse width is not greater than about 10 milliseconds.

15. The method of claim 13 wherein said second pulse width is not greater than about 1 millisecond.

16. The method of claim 13 wherein said second pulse train has a duty cycle less than said first duty cycle and not greater than about 50%.

17. The method of claim 1 wherein, in a third step, an electrolytic anodic etch is applied to shape the tips of the macroasperities of increased height formed in said second step.

* * * * *